US005235994A

United States Patent [19]

Comin et al.

[11] Patent Number: 5,235,994

[45] Date of Patent: Aug. 17, 1993

[54] DISHWASHING MACHINE WITH DETERGENT DISPENSER

[75] Inventors: Giovanni Comin, Gruaro; Dino Munini; Ivo Tonel, both of Pordenone, all of Italy

[73] Assignee: Zanussi Elettrodomestici S.p.A., Italy

[21] Appl. No.: 886,508

[22] Filed: May 20, 1992

[30] Foreign Application Priority Data

Jun. 7, 1991 [IT] Italy ..... PN91A000033

[51] Int. Cl.[5] ..... B08B 3/02

[52] U.S. Cl. ..... 134/93; 134/176; 134/179

[58] Field of Search ..... 134/93, 176, 179, 199, 134/200

[56] References Cited

U.S. PATENT DOCUMENTS

| | | | |
|---|---|---|---|
| 1,246,556 | 11/1917 | Crow | 134/93 |
| 1,997,849 | 4/1935 | Bargar | 134/93 |
| 2,038,260 | 4/1936 | Ash | 134/176 |
| 2,062,704 | 12/1936 | Forsyth, Jr. | 134/93 |
| 2,127,778 | 8/1938 | Lewis | 134/93 |
| 2,194,342 | 3/1940 | Walker | 134/93 X |
| 2,671,037 | 3/1954 | Stoddard . | |
| 3,444,870 | 5/1967 | Lyman | 134/179 |
| 3,699,785 | 10/1972 | Waugh . | |
| 3,809,106 | 5/1974 | Crabtree | 134/176 |
| 4,417,457 | 11/1983 | Brenner . | |

FOREIGN PATENT DOCUMENTS

| | | | |
|---|---|---|---|
| 1428499 | 1/1969 | Fed. Rep. of Germany | 134/179 |
| 1628600 | 8/1970 | Fed. Rep. of Germany | 134/176 |
| 1585578 | 5/1971 | Fed. Rep. of Germany . | |
| 386634 | 1/1965 | Switzerland . | |
| 1514652 | 6/1978 | United Kingdom . | |

*Primary Examiner*—Frankie L. Stinson

*Attorney, Agent, or Firm*—Pearne, Gordon, McCoy & Granger

[57] ABSTRACT

Dishwashing machine comprising a wash tub (3) in which is housed a removable basket (5) supporting a rotary spray arm (7) supplied by a nozzle (10) with a water jet extending throughout an air gap to be conveyed into a diffuser (11) connected with the spray arm. The detergent dispenser (1) comprises a cup-shaped element (20) adapted to contain the detergent and mounted on the basket (5) above the spray arm (7) and adjacent to the diffuser (11) so as to receive from above part of the water suspended in the wash tub. The cup-shaped element is arranged around the intake of the diffuser (11), by which it is driven into rotation through friction gear means (22) and to which it is connected through a central hole (21) for delivering the detergent.

It improves utilization of the detergent and prevents it from clotting.

9 Claims, 5 Drawing Sheets

DISHWASHING MACHINE WITH DETERGENT DISPENSER

DESCRIPTION

The present invention relates to a household dishwashing machine provided with an improved detergent dispenser to be used particularly, but not exclusively, to perform prewashing phases.

As is known, modern dishwashing machines are capable of carrying out a number of operative cycles which may be selected by the user and mainly comprise a washing phase which may be preceded by at least a prewashing phase (using hot water, or water at ambient temperature) and followed by at least a rinsing phase and at least a drying phase to dry up the crockery.

The water which is everytime contained in the wash tub of the dishwashing machine during relevant prewashing and washing phases is added with respective metered amounts of detergent dispensed by suitable detergent dispensers. For instance, the amount of detergent required to perform the prewashing phase is usually loaded into a metering recess, or the like, which is provided on the access door of the machine, so as to fall by gravity into the wash tub when the door is closed again to start operation of the machine. In this way the detergent tends to deposit on the bottom of the wash tub, in correspondence of the washing and drain water circuits of the dishwasher, so it may easily happen that a portion of the detergent is unused, instead of being completely dissolved in the water which is sprayed onto the crockery by suitable rotary spray arms supplied by a circulating pump.

Furthermore, a portion of the detergent may easily settle on in said recess, due to wetness, from which recess it is gradually flushed by water jets indirectly received from the spray arms during operation of the machine. This causes a delay in the chemical action exerted by the detergent on the crockery being washed, with the result that the prewashing phase (which is a relatively short-lasting phase) may be substantially ineffective.

Such a drawback is less remarkable as regards the detergent used in the washing phase (which generally lasts longer than the prewashing phase), which detergent is dispensed by a suitable dispenser normally closed by a door that is controlled to be opened at a preset time.

There is, at any rate, an undesirable waste of detergent which affects the general operative effectiveness of the dishwashing machine, can bring about scaling in the machine and is in contrast with the need to correctly save energy.

It is the main object of the present invention to provide a dishwashing machine with an improved detergent dispenser capable of enabling the detergent to be more properly used at the right time during operation of the machine.

Another object of the present invention is to provide a dishwashing machine of the afore-mentioned type in which deposit and/or scaling of detergent are substantially less likely to occur.

According to the invention, such objects are attained in a dishwashing machine with detergent dispenser embodying the features recited in the appended claims.

The characteristics and advantages of the invention will be more apparent from the following description, given only by way of non-limiting example, with reference to the accompanying drawings in which:

FIG. 1 diagrammatically shows a dishwashing machine according to the invention;

Figure 1:
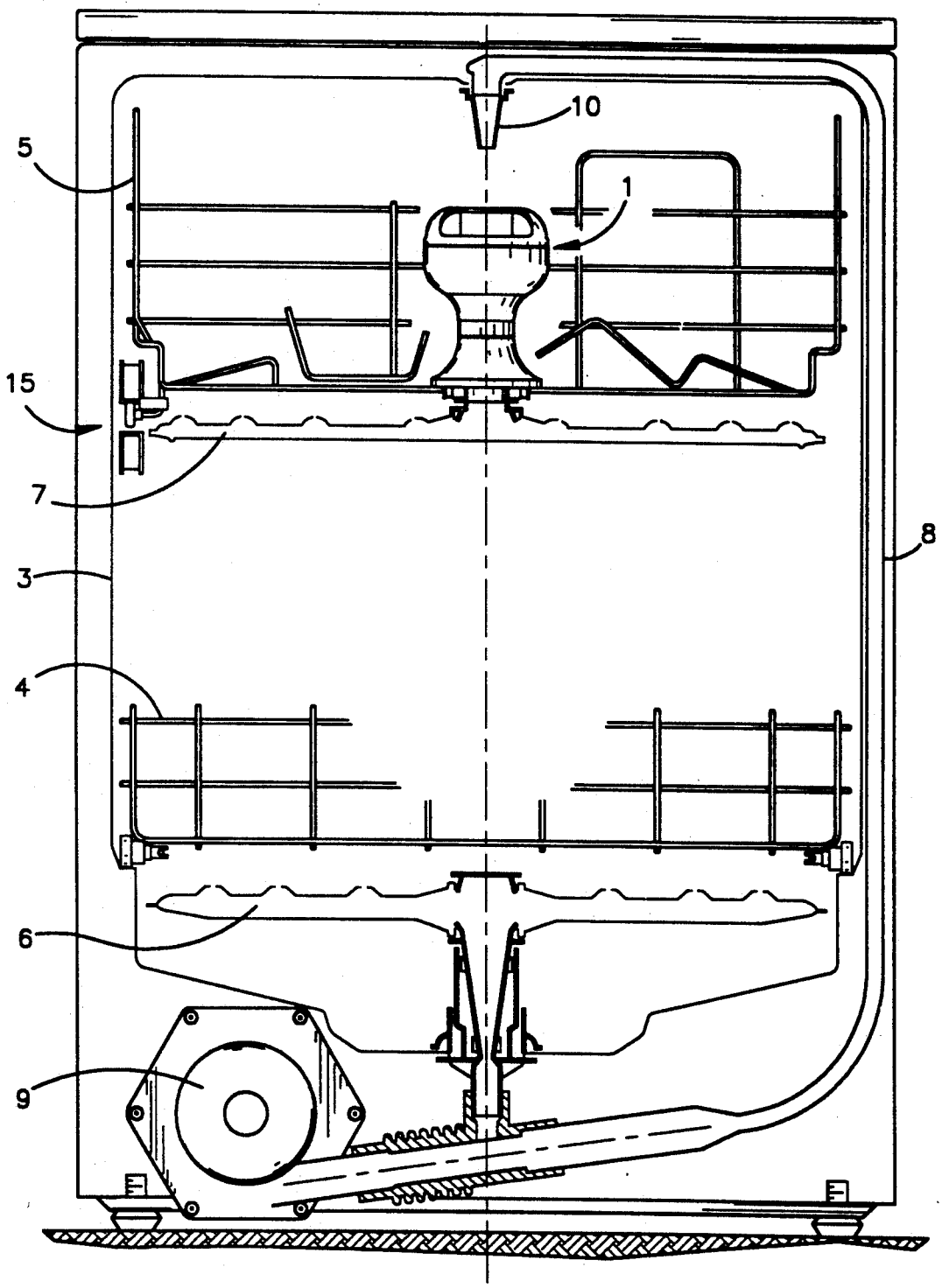
Figure 4:
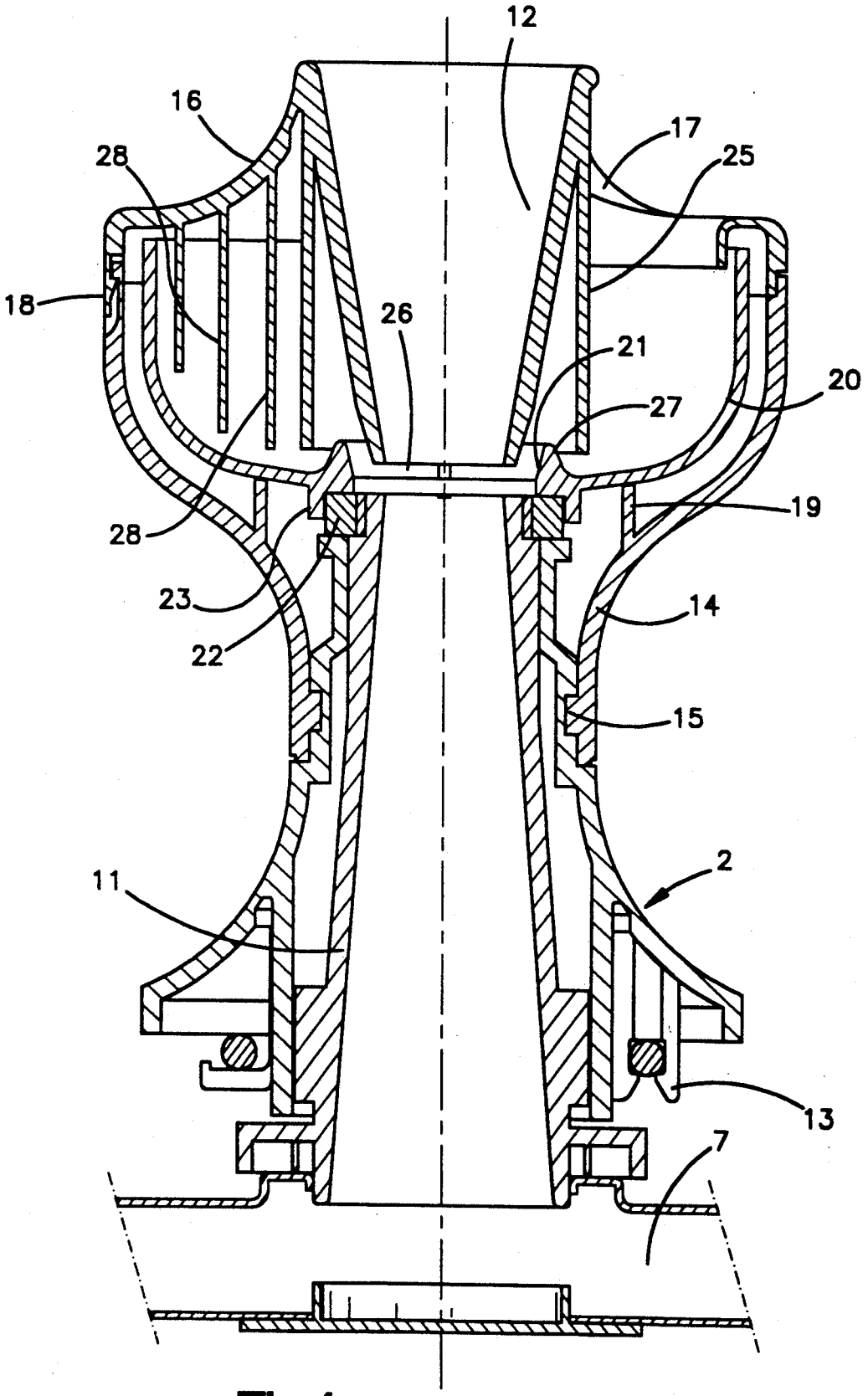
FIG. 4 shows a longitudinal cross-section of the detail, taken along lines IV—IV of FIG. 3.

With reference in particular to FIG. 1, the dishwashing machine basically comprises a wash tub 3 in which are housed at least a lower basket 4 and at least an upper basket 5, respectively, for supporting crockery. The baskets 4 and 5 are in known manner removable from the wash tub 3 and are disposed above relevant spray arms 6 and 7, respectively, arranged to be fed with water by a circulating pump 9 through a supply tube 8. More particularly, the supply tube 8 extends outside the wash tub 3 upwards and terminates with a central nozzle 10 projecting into the wash tub through the top wall thereof. The upper spray arm 7 is centrally provided with a substantially vertical water feeding conduit through which it is rotatably supported by the basket 5. As disclosed for instance in GB-A-1 514 652 and shown in FIG. 4, the water feeding conduit includes a diffuser 11 which is integral with the spray arm 7 and forms a rotary hydraulic joint with an adjacent convergent tubular portion 12. In particular, the diffuser 11 is freely rotatably mounted on the interior of a shaped support frame 2, that in turn is mounted on the basket 5 through snap-fitting fastening means 13 (se FIGS. 1 and 4). When the upper basket 5 is placed in position in the wash tub 3 the feeding conduit 11, 12 is axially aligned with the nozzle 10, from which it is spaced by an air gap, to collect a supply water jet therefrom.

Figure 2:
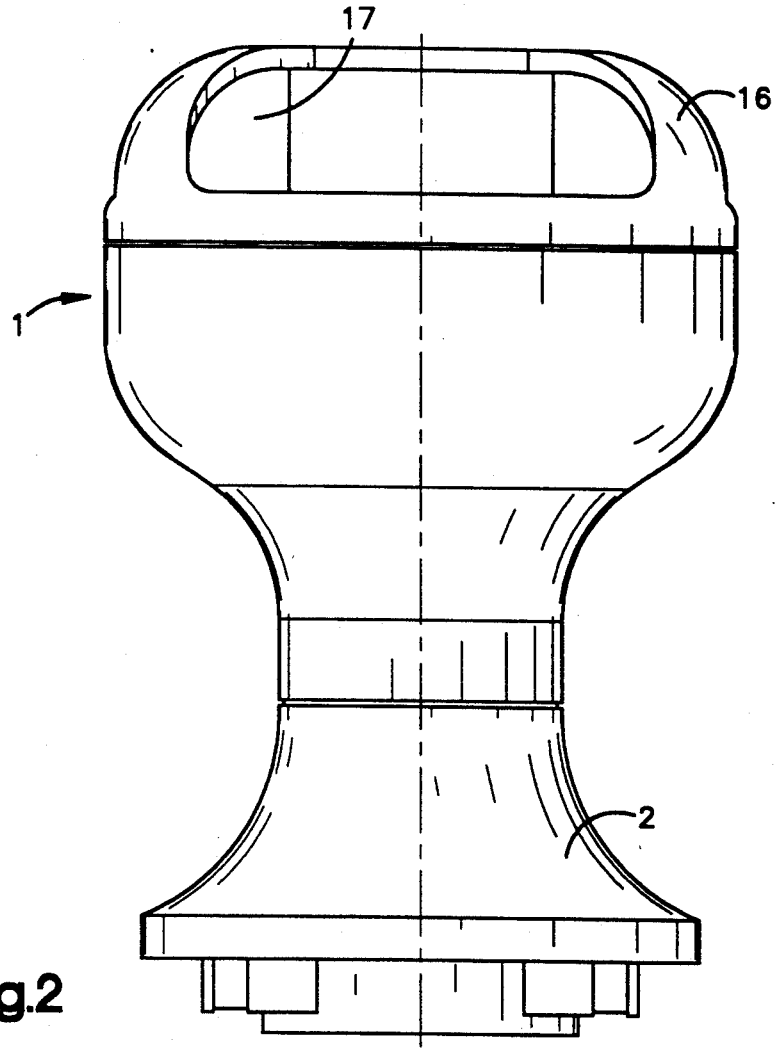
FIG. 2 shows an elevational view of an enlarged detail of the dishwashing machine as in FIG. 1, according to a preferred embodiment.
Figure 3:
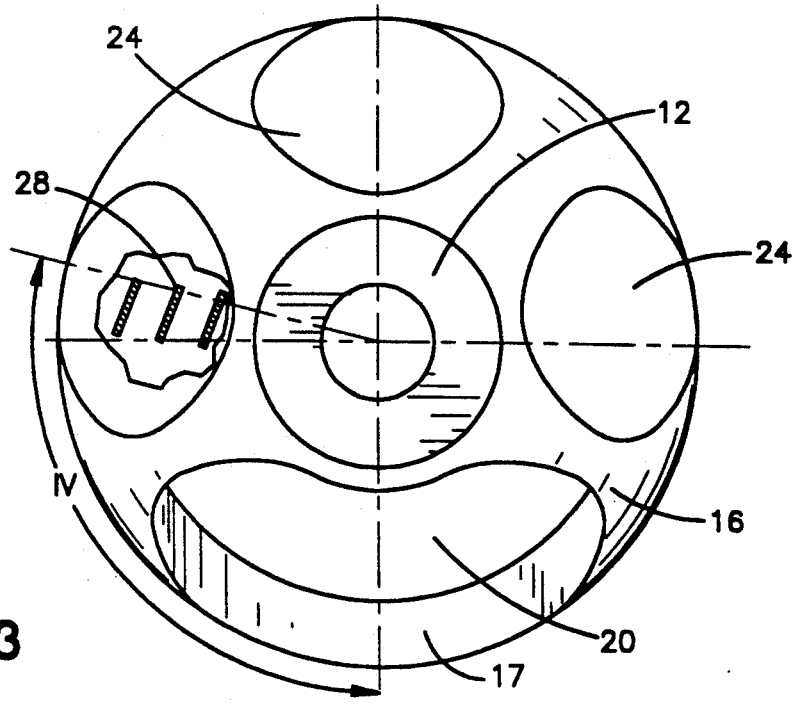
FIG. 3 shows a top view of the detail as in FIG. 2.

With reference also to FIGS. 2 and 3, according to the invention the feeding, or collecting conduit 11, 12 is associated with a detergent dispenser generally illustrated at 1. In a preferred embodiment, the dispenser 1 comprises a hollow body 14 having a goblet-shaped configuration, the lower portion of which is smaller in diameter and is mounted on the upper part of the support frame 2. More particularly, the body 14 is fitted about the frame 2, in a detachable fashion, through bayonet fitting means 15 or similar snap-fitting fastening means. The hollow body 14 is provided at the top with a cover member 16 which is preferably formed in a single piece with the convergent tubular portion 12 of the collecting conduit and has at least an aperture 17 for loading the detergent. Preferably, the cover 16 is formed with indentations 24 (see FIG. 3) which enable it to be suitably grasped, the cover being coupled with the body 14 in a detachable way, for instance through snap-fitting fastening means 18 (see FIG. 4), to the purpose of a possible cleaning of the whole detergent dispenser 1.

The inner surface of the hollow body 14 is provided with thin projections (or a corresponding annular rib) 19 which extend upwardly and upon which a substantially cup-shaped element 20 is arranged to rest coaxially. The coaxial element 20 is formed with a central hole 21 having a larger diameter than that of the coupling section between the tubular members 11 and 12 of the collecting conduit, and substantially aligned axially with an air gap 26 between the two members 11 and 12. The upper end of the diffuser 11 (that coupled with the convergent member 12) is rotatably integral with an outer clutch ring 22, the lower surface of which (smooth, in order to reduce friction) rests on the frame 2 for supporting purposes. The lower edge of the hole 21 of the cup-shaped element 20, in turn, rests on the upper surface of the ring 22, upon which the element 20 can be centred by means of a ring nut 23, or the like. The clutch ring 22, rotatably integral with the spray arm 7 and the diffuser 11, is capable of rotatably driving the cup-shaped element 20, and to this purpose its upper surface is preferably coupled with the lower edge of the hole 21 through friction means which are not shown for simplicity sake and for instance consist of relevant knurlings, or the like.

According to another aspect of the invention, the upper edge of the hole 21 is formed with an annular projection 27 extending axially towards the interior of the cup-shaped element 20; the upper end portion of the projection 27 is substantially surrounded by the edge of an annular wall 25 extending from the cover 16 downwardly. Hence, it is possible to load a suitable metered amount of detergent (preferably a powder detergent) into the cup-shaped element 20, through the loading aperture 17, without the risk of leakages of detergent through the hole 21. At the same time, the loading aperture 17 of the detergent dispenser 1 keeps being hydraulically in communication with the spray arm 7 via the interior of the cup-shaped element 20; the gap which separates the projection 27 of the cup-shaped element from the annular wall 25 and from the convergent member 12; the air gap 26; ;and the diffuser 11.

In operation, therefore, the user can first load a metered amount of detergent into the cup-shaped element 20 through the aperture 17; this operation is made easier thanks to the possibility of readily remove and place in position again the whole dispenser 1, by virtue of the bayonet fitting means 15. Obviously, depending on the characteristics of the dishwashing machine and the operative programme which is selected, the detergent may be used to perform either a washing or a prewashing cycle; in the latter case, a metered amount of detergent to carry out a subsequent washing phase may be supplied to the wash tub 3, at a proper time, by means of a traditional separate detergent dispenser, not shown for the sake of simplicity.

When the selected operative programme is started, the circulating pump 9 supplies water to the spray arms 6 and 7, which thereby issue a set of water jets impinging onto the crockery to be washed (not shown for simplicity sake) and rotate by hydraulic reaction. Therefore, the rotating spray arm 7 and the diffuser 11 drive also the cup-shaped element 20 into rotation, into which element part of the water which is suspended in the wash tub 3 penetrates from above through the aperture 17. This combined—mechanical and hydraulic—action conveys the detergent, through the gap among the projection 27 and the members 25 and 12 of the cover 16, and then through the air gap 26, along the diffuser 11 and to the spray arm 7. It should be noted that the detergent is also "drawn" into the diffuser 11 thanks to the negative pressure produced in correspondence of the air gap 26 by the water jet from the nozzle 10. As a result, the detergent is quickly and completely sprayed onto the crockery to be washed, along with the water jets issuing from the spray arm 7, the detergent being thereby able to exert its chemical action on the crockery, with no significant loss, right from the beginning of the operation of the machine.

The delivery of detergent from the dispenser 1 is preferably promoted by the provision of at least one scraper wall 28 (provided in the number of three, in the embodiment herein described) extending from the cover 16 downwards inside the cup-shaped element 20. As shown in FIG. 3, the scraper 28 is inclined towards the hole 21, with respect to the direction of rotation of the spray arm 7 (which rotates clockwise, in the present embodiment), so as to stir and convey the detergent to the hole 21 by virtue of the rotating movement of the cup-shaped element 20. As a result, the detergent dispenser 1 is particularly effective and "self-cleaning" in operation.

If, however, clots of detergent are formed in the dispenser 1, in particularly critical circumstances, which interfere with the rotation of the cup-shaped element 20, the frictional connection arrangement between the clutch ring 22 and the element 20 "skids", thereby enabling at least the spray arm 7 to rotate correctly so as to minimize all consequences in the operation of the machine.

Of course, the dishwashing machine described above may undergo a number of modifications without departing from the scopes of the invention.

Figure 5:
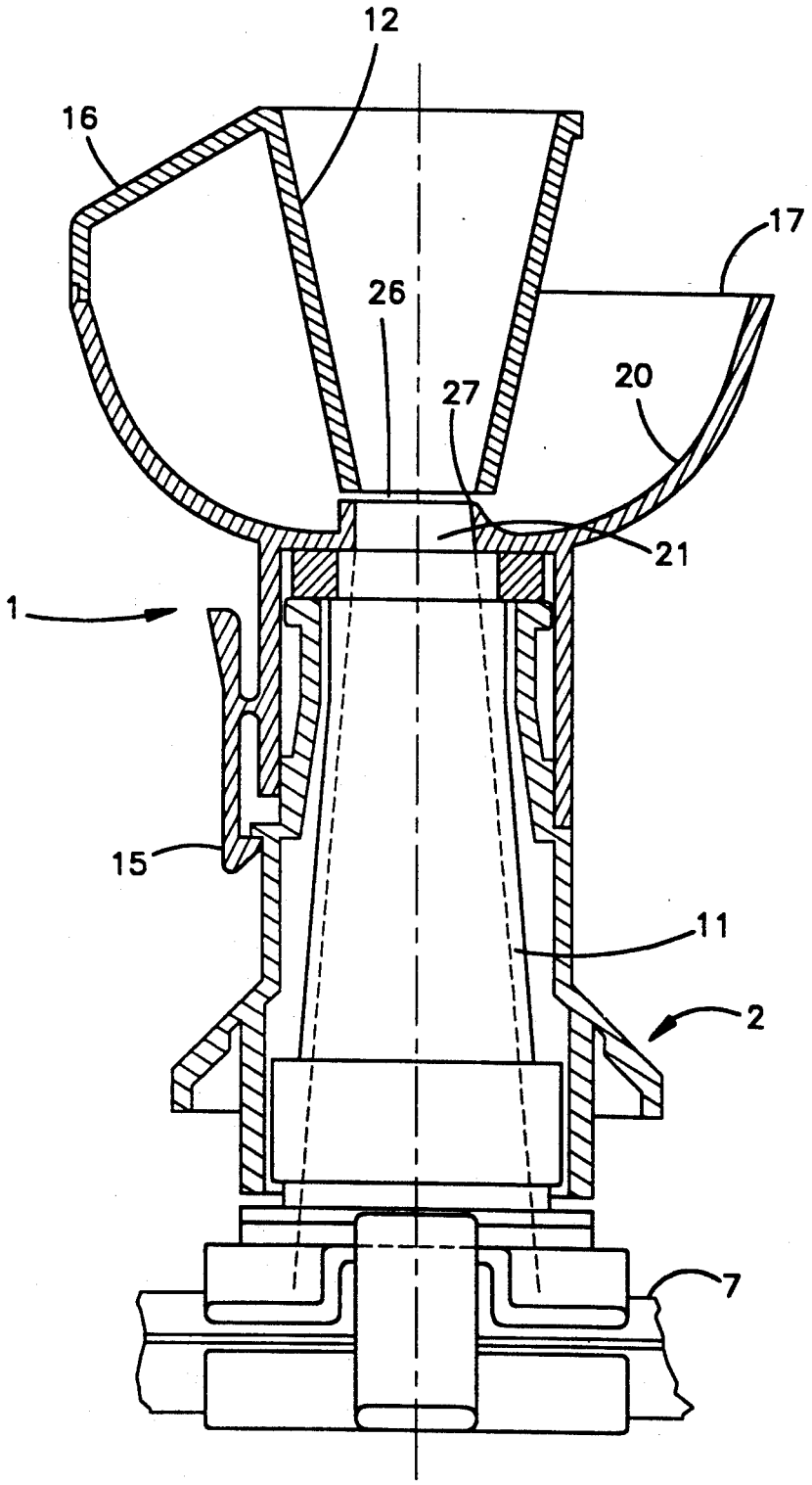
FIG. 5 shows a second embodiment of the detail as in FIG. 4.

In the alternative embodiment shown in FIG. 5, for example, the cup-shaped element 20 is steady, integral with the cover 16, while only the spray arm 7 and the diffuser 11 are rotatable. In addition, the central hole 21 of the cup-shaped element has a slightly smaller diameter than that of the coupling section between the tubular members 11 and 12, such that the end portion of the inner projection 27, which is preferably sharpened, forms an annular baffle which diverts part of the water flow from the convergent tubular member 12 and the air gap 26 towards the cup-shaped element 20. Hence, the detergent is flushed off the dispenser 1, through the loading aperture 17, toward the water jets, in particular those produced by the subjacent spray arm 7, so as to be intercepted by the water jets and brought into contact with the crockery being washed.

Figure 6:
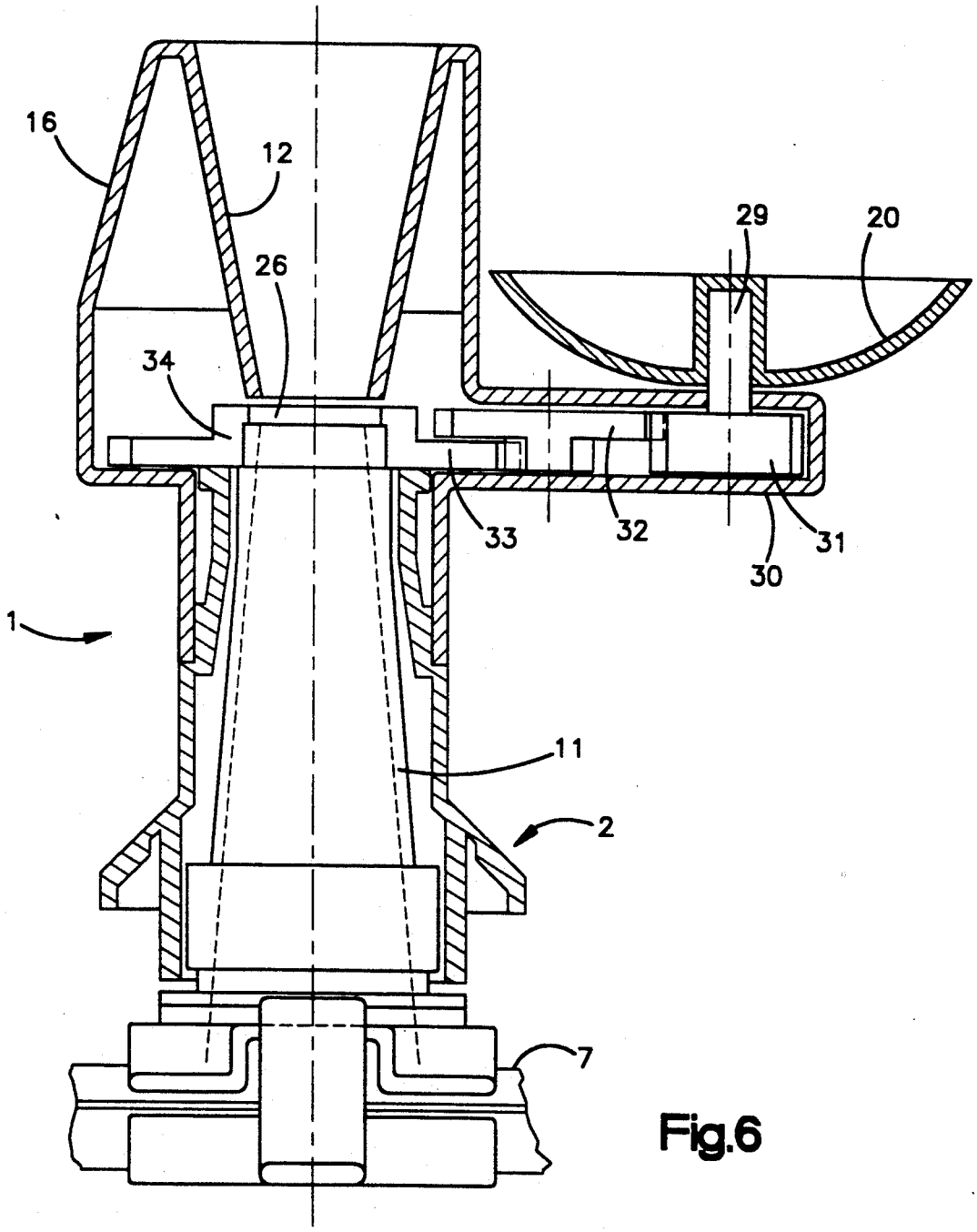
FIG. 6 shows a further embodiment of the detail as in FIG. 4.

In the embodiment shown in FIG. 6, the cup-shaped element 20 is arranged outside the detergent dispenser 1. In particular, the cup-shaped element 20 is keyed on a shaft 29 which is rotatably mounted on a side projection 30 of the hollow body 14 to be driven into rotation by the diffuser 11 through gear means. These latters for instance comprise a toothing 31 provided on the shaft 29 and connected via at least a gear wheel 32 with a corresponding toothing 33 provided on the outer surface of a gear ring 34, which is similar to the clutch ring shown in FIG. 4. The toothings 31, 33 and the gear wheel 32 are preferably housed within the side projection 30 of the detergent dispenser. In any case, when the circulating pump 9 is in operation the gear ring 34 rotates together with the diffuser 11 and the spray arm 7 and drives into rotation, with a suitable gear ratio, also the cup-shaped element 20.

Therefore, the detergent previously loaded into the cup-shaped element 20 is quickly and completely delivered by centrifugal action, as well as owing to the falling down of the water suspended in the wash tub 3, so as to be intercepted by the water jets of the subjacent spray arms 6, 7.

We claim:

1. A dishwashing machine comprising a wash tub (3) in which are housed a detergent dispenser and a removable basket (5) disposed above a relevant rotary spray arm (7) which is arranged to be supplied through a feeding conduit (11) with water circulated by a pump (9), so as to spray water jets towards said basket, characterized in that said detergent dispenser (1) comprises a substantially cup-shaped element (20) capable of containing the detergent and hydraulically and/or mechanically associated with said feeding conduit (11) to be flushed by part of the water circulated by said pump (9) so as to deliver said detergent towards said water jets, said cup-shaped element (20) being arranged to be driven into rotation by said conduit (11) through clutch means (22; 29,31,32,33).

2. Dishwashing machine according to claim 1, characterized in that said clutch means (22) are arranged to frictionally connect the cup-shaped element (20) with said diffuser (11).

3. Dishwashing machine according to claim 1 or 2, characterized in that said detergent dispenser (1) comprises a side projection (30) on the exterior of which said cup-shaped element (20) is rotatably mounted, so as to receive from above part of the water sprayed by said spray arm (7) and to deliver the detergent, by centrifugal action, into the wash tub (3), where it is intercepted by the water jets produced by the spray arm.

4. A dishwashing machine comprising a was tub (3) in which are housed at least a detergent dispenser and at least a removable basket (5) disposed above a relevant rotary spray arm (7) which is arranged to be supplied through a feeding conduit (11) having an air gap (26) and a diffuser rotatably integral with the spray and with water circulated by a pump (9), so as to spray water jets towards said basket, characterized in that said detergent dispenser (1) comprises a substantially cup-shaped element (20) capable of containing the detergent and including a central hole (21) whose edge substantially surrounds said air gap (26) in correspondence of the diffuser (11), the cup-shaped element being arranged to receive from above part of the water sprayed by said spray arm (7), so as to deliver the detergent towards said water jets through said central hole (21), said air gap (26), said diffuser (11) and said spray arm (7).

5. Dishwashing machine according to claim 4, characterized in that the edge of said central hole (21) is formed with an annular projection (27) extending within the cup-shaped element (20).

6. Dishwashing machine according to claim 4, characterized in that said detergent dispenser (1) comprises a hollow body (14) which is mounted on said basket (5), houses said cup-shaped element (20) and is provided at the top with a cover member (16) having a convergent tubular member (12) that forms part of said feeding conduit and is coupled with the diffuser (11) through said air gap (26), said cover member being provided with at least an aperture (17), for loading the detergent, arranged to receive said part of the water sprayed by the spray arm (7).

7. Dishwashing machine according to claims 1 or 6, characterized in that said cover member (16) comprises at least one scraper wall (28) extending within the cup-shaped element (20) and inclined towards said central hole (21) with respect to the direction of rotation of said spray arm (7).

8. A dishwashing machine comprising a wash tub (3) in which are housed at least a detergent dispenser and at least a removable basket (5) disposed above a relevant rotary spray arm (7) which is arranged to be supplied through a feeding conduit (11) having an air gap (26) and a diffuser which is rotatably integral with the spray arm with water circulated by a pump (9), so as to spray water jets towards said basket, characterized in that said detergent dispenser (1) comprises a substantially cup-shaped element (20) capable of containing the detergent, including a central hole (21) substantially coaxial with the diffuser (11) and located in correspondence of said air gap (26), the edge of said central hole being formed with an annular projection (27) extending within the cup-shaped element and arranged to divert into the cup-shaped element (20) part of the water being circulated through said air gap (26), so as to flush the detergent into the wash tub (3), where it is intercepted by the water jets produced by the spray arm (7).

9. Dishwashing machine comprising a wash tub (3) in which are housed at least a detergent dispenser and at least a removable basket (5) disposed above a relative rotary spray arm (7) which is arranged to be supplied through a feeding conduit (11) with water circulated by a pump (9), so as to spray water jets toward said basket, characterized in that said detergent dispenser (1) comprises a substantially cup-shaped element (20) rotatably mounted on a side projection (30) of the dispenser and capable of containing the detergent and hydraulically and/or mechanically associated with said feeding conduit (11) to be flushed by part of the water circulated by said pump (9).

* * * * *